United States Patent [19]

Carnahan et al.

[11] Patent Number: 5,018,974

[45] Date of Patent: May 28, 1991

[54] COLORING BOOK OR THE LIKE WITH INK-REACTIVE, FRAGRANCE-RELEASING AREAS

[75] Inventors: David W. Carnahan, East Ridge; Paul J. A. French, Signal Mountain; Richard K. Maury, Hixson; Gary L. Akins, Chattanooga, all of Tenn.; Philip J. Oaten, Yardley, Pa.

[73] Assignees: Arcade, Inc., Chattanooga, Tenn.; Perfume International, Inc., Yardley, Pa. ; part interest to each

[21] Appl. No.: 527,137

[22] Filed: May 22, 1990

[51] Int. Cl.[5] ..... A63F 9/10; G09B 19/00

[52] U.S. Cl. ..... 434/98; 428/905

[58] Field of Search ..... 434/98, 84, 81, 347, 434/85, 333, 346; 252/316; 428/905; 239/36

[56] References Cited

U.S. PATENT DOCUMENTS

| | | | |
|---|---|---|---|
| 3,570,139 | 3/1971 | Ladd et al. | 434/346 |
| 4,243,224 | 1/1981 | Spector | 434/333 |
| 4,687,203 | 8/1987 | Spector | 434/347 |
| 4,762,493 | 8/1988 | Anderson | 428/905 |

*Primary Examiner*—Stephen R. Crow
*Assistant Examiner*—Glenn Richman
*Attorney, Agent, or Firm*—Phillips & Beumer

[57] ABSTRACT

A coloring book or the like is provided with image areas that release an appropriate fragrance upon being colored or painted by the user. Microcapsules that contain fragrance oil for a particular fragrance associated with the image area are deposited on the image area of the substrate. Inert walls of materials such as gelatin restrain the fragrance within the microcapsules until activated. A color dispenser such as a felt tip marking pen is adapted to include a reactive agent that when applied to the image area in the normal course of coloring will cause release of the fragrance by rupturing or otherwise interacting with the microcapsules such as by diffusing into the microcapsules and replacing and releasing the oil. The reactive agent may be a solvent such as an alcohol or ketone or a surfactant contained in an aqueous solution mixed with the normal ink or paint of the marking pen. The invention enables release of fragrances in the normal course of coloring an image without requiring action such as scratching or pulling apart of the sheets on which the image is placed.

12 Claims, 1 Drawing Sheet

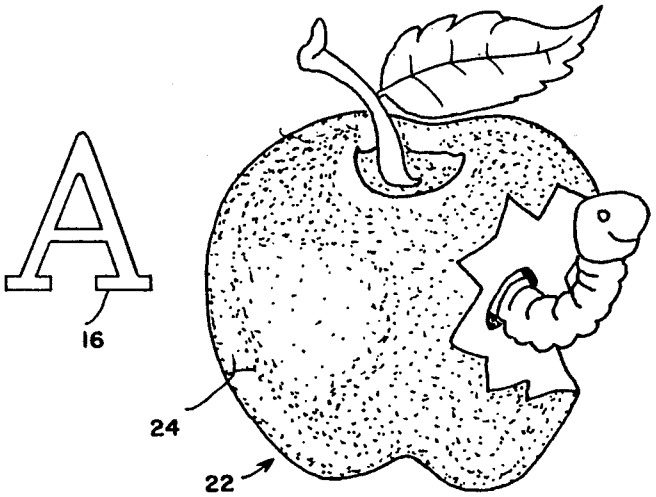
FIG. 2
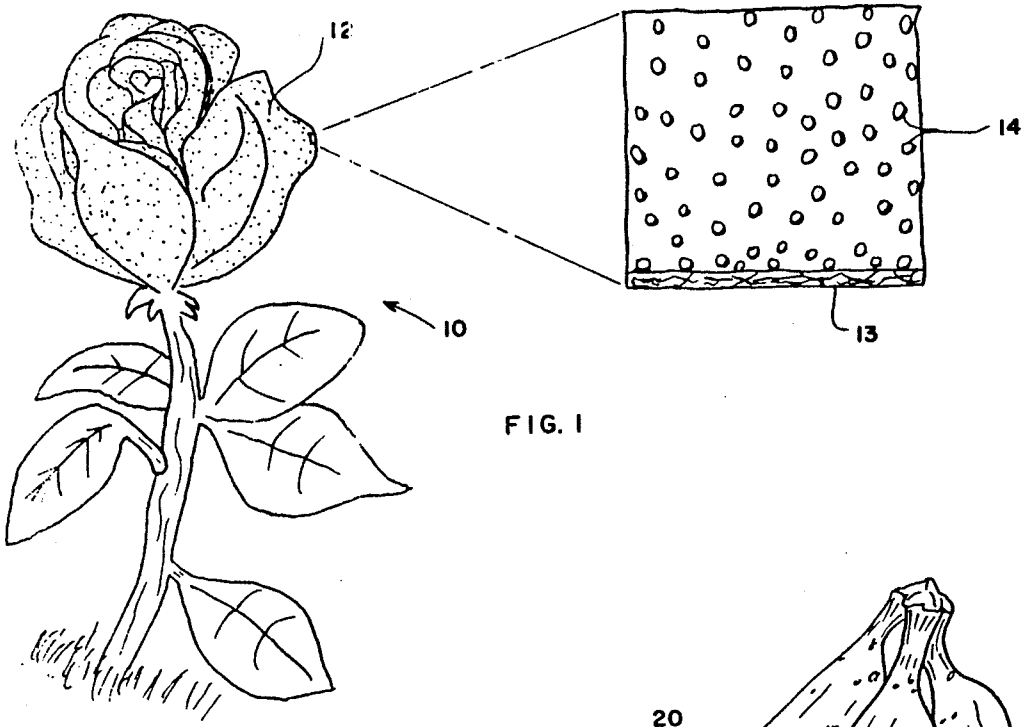
FIG. 1
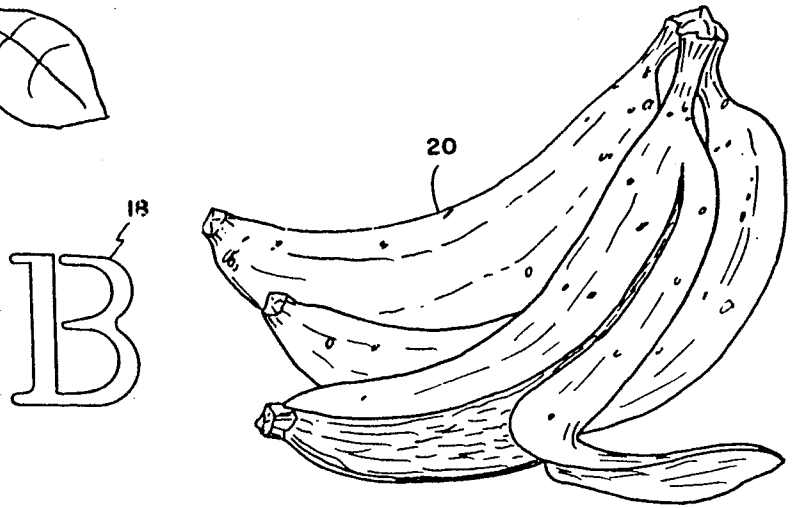

COLORING BOOK OR THE LIKE WITH INK-REACTIVE, FRAGRANCE-RELEASING AREAS

FIELD OF THE INVENTION

This invention relates to coloring books, color tablets, educational coloring materials, or similar articles having image areas for coloring by a user and to the provision of releasable fragrance on substrate areas of such articles.

BACKGROUND OF THE INVENTION

Various products including coloring books and paint-by-number drawings have printed drawings on a paper substrate with specific areas intended to be colored or painted a specific color by the user. Such products would be enhanced by providing a source of releasable fragrance deposited on specific areas of the drawing that may be associated with a particular fragrance. For example, an area showing a flower could contain a source of releasable fragrance corresponding to the fragrance of that flower. A fragrance source for such purposes should be provided in a form such that the fragrance is not subject to premature release in routine handling and marketing of the product but remains securely contained and inert until released by the user during the act of coloring or painting. Other desired characteristics of the source of a releasable fragrance are that it should be readily applied to paper substrates, and any actions required for release of the fragrance should not interfere with normal coloring or painting. Providing for controlled release of fragrance from image areas in this manner would result in a significant educational benefit for children, contributing to their awareness regarding a depicted image and increasing their fun and interest in this activity.

Releasable fragrances contained in rupturable microcapsules are widely used in products such as advertising samplers. Microcapsules for this purpose may be prepared by preparing an emulsion of perfume oil droplets and forming capsule walls of an inert material such as gelatin or urea-formaldehyde around the droplets to obtain very small microcapsules, typically ranging upward in size from a few microns. The resulting microcapsules may be applied to selected areas of a paper substrate by use of a printing press or other known techniques. Release of the contained fragrance by the recipient of the sampler is obtained by scratching or rubbing of an exposed substrate, thus the designation of "scratch and sniff" as commonly applied to such products. Methods of preparing microcapsules and articles based on them are described in numerous prior patents, for example, U.S. Pat. No. 3,516,941, issued June 23, 1970, to Matson, and U.S. Pat. No. 4,277,364, issued July 7, 1981, to Shasha et al.

SUMMARY OF THE INVENTION

This invention is directed to a coloring book or the like having fragrance-containing microcapsules deposited on an image area of a substrate, the deposited fragrance corresponding to or being associated with the subject matter depicted on that area. Release of the fragrance is obtained by applying to the area an ink or paint which contains a colorant appropriate for the area and an agent that is reactive with the microcapsules to cause release of contained fragrance in the normal act of coloring. The reactive agent is preferably provided in solution with a liquid ink, and it may take the form of various organic solvents or surfactants contained in aqueous solutions which rupture the walls of the microcapsules or enter into the walls and replace the perfume oil therein by diffusion or other mechanism. A dispenser for the coloring material and reactive agent may take the form of a conventional felt tip marker pen. This provides for release of the fragrance in the normal act of coloring or painting without requiring scratching, tearing apart, or abrasion of the microcapsules. Enhanced interest and awareness on the part of children while using products embodying the invention are provided along with greater enjoyment of the activity.

It is, therefore, an object of this invention to provide an image area of a colorable substrate that contains a releasable fragrance corresponding to the subject matter shown in that area.

Another object is to provide a color dispenser that includes a reactive agent for releasing contained fragrance from a substrate during the normal act of coloring.

Still another object is to provide a coloring kit that includes a releasable fragrance on an image area of a substrate and a dispenser that provides a desired colorant and a fragrance-releasing reactive agent.

Other objects and advantages of the invention will be apparent from the following detailed description and appended claims.

BRIEF DESCRIPTION OF THE DRAWINGS

FIG. 1 is a pictorial view showing a coloring book page having fragrance-containing microcapsules deposited on an image area showing a flower.

FIG. 2 shows a coloring book page with alphabet-related images having microcapsules containing fragrance oils deposited thereon.

DESCRIPTION OF THE PREFERRED EMBODIMENT

FIG. 1 of the drawings shows an image of a rose 10 having a blossom area 12 of paper substrate 13 upon which microcapsules 14 containing rose perfume oil are deposited. Upon coloring this area with an ink that contains a reactive agent, the fragrance of the oil is released from the microcapsules.

FIG. 2 shows an embodiment of the invention for a children's first book where letters of the alphabet 16 and 18 are shown along with a fruit 20 and 22 beginning with that letter. The fruit image areas have deposited thereon microcapsules 24 that contain a fragrance oil for the particular fruit. When ink containing a reactive agent is applied to the image areas, the fragrance of the respective fruit is released.

Microcapsules for use in the present invention may be made up of very small droplets of fragrance oil encapsulated with an inert wall material such as gelatin. Preferably the microcapsules may be prepared by forming an emulsion of perfume oil droplets in an aqueous system by combining the oil with gelatin and water, thoroughly agitating the mixture, and adding an agent such as gum arabic or sodium polyphosphate that induces complex coacervation in the system, with droplets of oil being encapsulated by deposition of the coacervate around the individual droplets. A cross linking agent such as formaldehyde or glutaraldehyde may also be used to strengthen the capsule walls. Further details of this method are given in co-pending patent application Ser.

No. 292,495, filed Dec. 30, 1988, and assigned to a common assignee. The microcapsule walls may also be formed of a reaction product of urea and formaldehyde and various other polymeric materials such as poly-(ethylene-covinyl acetate), polyvinyl alcohol, methyl cellulose, ethyl cellulose, polyethylene maleicanhydride, or polyurethane, which are known in the art for this purpose. The fragrance content of the microcapsules is selected for its capabilitY to represent the fragrance associated with a particular image area. Fragrance oil representing various flowers such as roses as well as numerous other products or articles are available from scent suppliers. A listing of articles or scenes and the fragrance oils to be provided in microcapsules deposited over an image of the article or scene may be as follows: forest, pine scent; fireplace, smoke; Christmas tree, pine; candy canes, peppermint; fruit basket, pineapple; candy dish, cinnamon; soda can, lemon-lime; campfire, smoke; decorations on toy house, cinnamon or peppermint. Scents associated with bubble gum and foods such as pizza and french fried potatoes may also be used. Fragrance oil for such scents may be incorporated into microcapsules using known processes as described above.

Another format for presentation of images with microcapsules containing fragrance oils would take the form of a children's first book in which letters of the alphabet are presented along with an image of an article beginning with that letter. For example, the letter "A" with an apple image and an apple scent, "B" with a banana image and scent, and so forth. Images of monsters or other ugly creatures may be provided with microcapsules containing foul-smelling scents to provide an experience consistent with toys based on such ghoulish creatures. For this application, the images could be printed on cards similar to baseball cards to enable them to be traded.

Application of the microcapsules containing fragrances to the desired image areas of a substrate may be carried out in the same manner as employed previously for advertising samplers and the like. In a preferred procedure, an aqueous slurry of fragrance-containing microcapsules is made up to provide the consistency of printing ink and is selectively deposited by means of a printing press using known techniques.

The reactive agent for releasing fragrance from deposited microcapsules is provided in a color-diepeneing instrument, preferably a conventional felt tip marking pen that applies pigmented ink or fluid paint-like material in the form of a liquid or flowable dispersion. The dispensing instrument may also take the form of a paint brush, sponge, air brush, roller, or other applicator. The colorant may also be applied by a finger of the user. The term "reactive agent" as used herein is intended to mean any substance that undergoes a physical or chemical reaction with the microcapsules to cause a fragrance oil to be removed from within the microcapsule core. Although the invention is not to be understood as limited to a particular mechanism, the preferred agents are believed to produce a lysing reaction, causing small cracks to be formed in the microcapsule walls. The reactive agents diffuse into the microcapsule, replacing and releasing the oil. Examples of suitable reactive agents include alcohols such as ethanol, propylene glycol and diethylene glycol, glycerine, ketones, aqueous solutions of urea amides, and similar solutes. Surfactants such as cocoamphodiacetate or sodium stearate in aqueous solution may also be used. The reactive agent may be provided in the ink or coloring paint at an effective amount of concentration, which may vary widely depending upon the particular agent. Typically, a concentration of about 30 percent gives good results. Upon application of the ink or paint, the reactive agent migrates to the microcapsule walls and causes them to release contained fragrance oil. While other materials would be effective reactive agents, it is preferred to use a polyhydric alcohol such as propylene glycol or diethylene glyxol or a surfactant such as cocoamphodiacetate because of their non-toxic nature.

The invention is further illustrated by the following examples.

EXAMPLE 1

A blue ink was prepared using 100 grams of a 50-percent aqueous solution of cocoamphodiacetate and 2 grams of amido black 10B pigment. A felt tip pen was filled with ink, which was dark blue ink in color. Upon coloring french fry scented microcapsules, the odor of french fries was released.

EXAMPLE 2

A red ink was prepared using 200 grams of water and 2 grams of congo red pigment and 20 grams of the surfactant of Example 1. A felt tip pen was filled with red ink, and the microcapsules were colored with the red ink. The fragrance in the microcapsule was rose and was released when colored with the ink.

EXAMPLE 3

A blue ink was placed over microcapsules containing rose perfume oil, the blue ink including the surfactant of Example 1. The fragrance of the rose was released.

EXAMPLE 4

A solvent-containing ink was prepared by mixing 2 grams of Solvent Green 3 pigment in 100 grams of ethanol. A felt tip pen was then charged with the ink, and bubble gum microcapsules which had been printed onto paper were colored with the pen. Upon coloring with the dark green ink, the microcapsules were ruptured, and the smell of bubble gum was observed.

EXAMPLE 5

A red ink was prepared using 25 grams sodium stearate and 74 grams de-ionized water and 1 gram FD&C Red 40 pigment. A felt tip pen was filled with ink, which was red in color. Upon coloring french fry-scented microcapsules, the odor of french fries was released.

EXAMPLE 6

A red ink was prepared according to Example 5. The ink was applied using a brush to french fry-scented microcapsules, whereby the odor of french fries was released.

EXAMPLE 7

A red ink was prepared using 99 grams glycerine and 1 gram FD&C Red 40 pigment. A felt tip pen was filled with ink, which was red in color. Upon coloring french fry-scented microcapsules, the odor of french fries was released.

EXAMPLE 8

A red ink was prepared according to Example 7. The ink was applied using a brush to french fry-scented microcapsules, whereby the odor of french fries was released.

EXAMPLE 9

A red ink was prepared using 45 grams glycerine, 54.5 grams de-ionized water, and 5 grams FD&C Red 40 pigment. A felt tip pen was filled with ink, which was red in color. Upon coloring french fry-scented microcapsules, the odor of french fries was released.

EXAMPLE 10

A red ink was prepared according to Example 9. The ink was applied using a brush to french fry-scented microcapsules, whereby the odor of french fries was released.

What is claimed is:

1. A coloring or painting kit providing release of a fragrance associated with an image area comprising:

a substrate having depicted thereon at least one image area associated with a fragrance;

microcapsules deposited on said image area, said microcapsules having a rupturable inert wall and a central core of a fragrance oil;

a dispenser for applying a colorant in flowable form for application to said image area; and an agent included in said colorant for reaction with said microcapsules so as to release said fragrance.

2. A kit as defined in claim 1 wherein said substrate is a paper sheet or card.

3. A kit as defined in claim 2 wherein said reactive agent is an organic solvent or an aqueous surfactant-containing solution.

4. A kit as defined in claim 3 wherein said microcapsule walls are comprised of gelatin.

5. A kit as defined in claim 4 wherein said dispenser is a paint brush, and the colorant is a paint.

6. A kit as defined in claim 4 wherein said dispenser is a sponge, and the colorant is a paint.

7. A kit as defined in claim 4 wherein said dispenser is an air brush, and the colorant is a paint.

8. A kit as defined in claim 4 wherein said dispenser is a rolling device, and the colorant is a paint.

9. A kit as defined in claim 1 wherein said colorant is a finger paint.

10. A kit as defined in claim 4 wherein said dispenser is a felt tip marker, and the colorant is an ink.

11. A kit as defined in claim 5 wherein said reactive agent is a polyhydric alcohol or an aqueous solution of a surfactant.

12. A child's coloring book for being colored comprising: an ink containing marking pen;

a plurality of paper sheets providing substrates having images depicted thereon;

at least one area of a said image being associated with a fragrance;

microcapsules deposited on said image area and comprising an inert wall and a droplet of a fragrance oil for said fragrance and contained in said microcapsule; and said microcapsules being rupturable to release said fragrance by reaction therewith of an agent carried in said marking pen.

* * * * *